US009431765B2

(12) United States Patent
Tao

(10) Patent No.: US 9,431,765 B2
(45) Date of Patent: Aug. 30, 2016

(54) DECORATIVE TREE AND QUICK ASSEMBLY CONNECTOR THEREFOR

(71) Applicant: Hou Yan Tao, Huizhou (CN)

(72) Inventor: Hou Yan Tao, Huizhou (CN)

(73) Assignees: J&J Seasonal Company Ltd., Kowloon (HK); Equinox 2 Inc., Charleston, SC (US)

( * ) Notice: Subject to any disclaimer, the term of this patent is extended or adjusted under 35 U.S.C. 154(b) by 0 days.

(21) Appl. No.: 14/485,220

(22) Filed: Sep. 12, 2014

(65) Prior Publication Data

US 2015/0079850 A1 Mar. 19, 2015

(30) Foreign Application Priority Data

Sep. 18, 2013 (CN) ..... 2013 2 0579668 U

(51) Int. Cl.

| | |
|---|---|
| ***H01R 13/64*** | (2006.01) |
| ***H01R 13/645*** | (2006.01) |
| ***A47G 33/06*** | (2006.01) |
| ***H01R 13/24*** | (2006.01) |

(52) U.S. Cl.

CPC ..... *H01R 13/6456* (2013.01); *A47G 33/06* (2013.01); *H01R 13/24* (2013.01)

(58) Field of Classification Search

CPC ... H01R 13/6456; H01R 13/24; A47G 33/06

USPC ..... 439/677, 680, 529, 533, 542–543; 428/17–20

See application file for complete search history.

(56) References Cited

U.S. PATENT DOCUMENTS

| | | | | |
|---|---|---|---|---|
| 3,970,834 | A | 7/1976 | Smith | |
| 5,855,705 | A * | 1/1999 | Gauthier | F21S 4/001 428/18 |
| 6,869,316 | B2 | 3/2005 | Hinkle et al. | |
| 7,132,139 | B2 * | 11/2006 | Yang | A47G 33/06 428/17 |
| 8,053,042 | B1 | 11/2011 | Loomis | |
| 8,298,633 | B1 | 10/2012 | Chen | |
| 8,454,186 | B2 | 6/2013 | Chen | |
| 8,454,187 | B2 | 6/2013 | Chen | |
| 8,876,321 | B2 * | 11/2014 | Chen | F21V 33/00 362/123 |

(Continued)

FOREIGN PATENT DOCUMENTS

CN 203521816 4/2014

OTHER PUBLICATIONS

U.S. Appl. No. 61/552,944, filed Oct. 28, 2011.

*Primary Examiner* — Felix O Figueroa

(74) *Attorney, Agent, or Firm* — Amster, Rothstein & Ebenstein, LLP

(57) ABSTRACT

A decorative tree is disclosed, and includes a base, a vertical column supported by the base and including a plurality of interconnected hollow tubes, and a power connector assembly. The power connector assembly includes a first connector terminal and a second connector terminal. The first connector terminal includes a raised step including an annular wall with a discontinuity that defines a positioning groove, and a pair of electrical contacts exposed on the annular wall. The second connector terminal includes an annular recess configured to receive the raised step, an annular ring disposed within the annular recess, and a pair of conductive terminals extending from the annular ring. Each of the conductive terminals is configured for contact with a corresponding electrical contact of the pair of electrical contacts. A positioning key extends from the annular ring and is configured for insertion into the positioning groove.

36 Claims, 2 Drawing Sheets

(56) References Cited

U.S. PATENT DOCUMENTS

2012/0009360 A1 1/2012 Fu et al.
2013/0108808 A1 5/2013 Leung et al.
2013/0120971 A1 5/2013 Chen
2014/0087094 A1 3/2014 Leung et al.

* cited by examiner

DECORATIVE TREE AND QUICK ASSEMBLY CONNECTOR THEREFOR

CROSS-REFERENCE TO RELATED APPLICATION

This application claims the benefit of and priority to Chinese Utility Model Application Number CN 201320579668, filed on Sep. 18, 2013 (issued as Chinese Utility Model Number CN 203521816), the entire contents of which are incorporated by reference herein.

TECHNICAL FIELD

The present invention generally relates to a quick assembly pre-lit decorative tree and to electrical power connections for use with such decorative trees, and in embodiments, to electrical power connections for use with a decorative tree that are configured for safe and efficient connection and disconnection.

BACKGROUND OF THE INVENTION

Decorative structures, such as decorative trees, are prominently used during a number of celebrations, for example, Christmas or general Winter-themed occasions.

Decorative trees often include a base supporting a column or trunk, and may include twigs, leaves, and/or branches extending therefrom. Additional structures, such as branches, garland, tinsel, ornaments, and/or electrical lighting may be disposed along branches or other portions of the decorative tree. In the case of electrical lighting, a decorative tree may require one or more electrical connections to be present in order to transfer electrical power between separate electrically-powered components disposed along portions of the decorative tree, for example, strands of electrical lighting disposed along different branches or sections of the tree.

Thus, during assembly or disassembly of the decorative tree, a user may be required to couple or uncouple multiple electrical connections in addition assembling physical components of the decorative tree.

SUMMARY

It is an object of the present invention to address challenges presented by the use of existing electrical lighting elements with decorative trees by providing a power connector assembly for use with decorative trees that is configured for safe and efficient assembly and disassembly.

In an exemplary embodiment, a decorative tree is disclosed, and comprises a base, a vertical column supported by the base and comprising a plurality of interconnected hollow tubes, and a power connector assembly. The power connector assembly comprises a first connector terminal and a second connector terminal. The first connector terminal comprises a raised step including an annular wall with a discontinuity that defines a positioning groove or keyway, and a pair of electrical contacts exposed on the annular wall. The second connector terminal comprises an annular recess configured to receive the raised step, an annular ring disposed within the annular recess, and a pair of conductive terminals extending from the annular ring. Each of the conductive terminals is configured for contact with a corresponding electrical contact of the pair of electrical contacts. A positioning key extends from the annular ring and is configured for insertion into the positioning groove or keyway.

In exemplary embodiments, a body of the first connector terminal surrounding the pair of electrical contacts is formed of an electrically insulative material.

In exemplary embodiments, a body of the second connector terminal surrounding the pair of electrical contacts is formed of an electrically insulative material.

In exemplary embodiments, the conductive terminals are each configured for movement relative to the remainder of the second connector terminal.

In exemplary embodiments, the conductive terminals each include a resiliently deformable element.

In exemplary embodiments, the plurality of hollow tubes of the vertical column includes two hollow tubes.

In exemplary embodiments, the decorative tree further comprises a connecting tube configured for interconnecting the two hollow tubes.

In exemplary embodiments, the first connector terminal defines a hole therethrough for receiving a portion of the vertical column.

In exemplary embodiments, the second connector terminal defines a hole therethrough for receiving a portion of the vertical column.

In exemplary embodiments, the positioning key is spaced a radial distance between the pair of conductive terminals that is equal to a radial distance at which the positioning groove is spaced between the pair of electrical contacts.

In exemplary embodiments, the pair of conductive terminals in each of the first and second connector terminals is outside of the hole in the center of the power connector assembly.

In an exemplary embodiment of the present invention, a power connector assembly for use with a decorative tree comprises a first connector terminal and a second connector terminal. The first connector terminal defines a hole extending therethrough for receiving a portion of the decorative tree, and the second connector terminal defines a hole extending therethrough for receiving a portion of the decorative tree. The first connector terminal comprises a raised step including an annular wall with a discontinuity that defines a positioning groove, and a pair of conductive terminals extending from the annular wall. The second connector terminal comprises an annular recess configured to receive the raised step, an annular ring disposed within the annular recess and having a pair of electrical contacts disposed thereon, each configured for contact with a corresponding conductive terminal of the pair of conductive terminals, and a positioning key extending from the annular ring and configured for insertion into the positioning groove.

In exemplary embodiments, a body of the second connector terminal surrounding the pair of electrical contacts is formed of an electrically insulative material.

In exemplary embodiments, a body of the first connector terminal surrounding the pair of electrical contacts is formed of an electrically insulative material.

In exemplary embodiments, the conductive terminals are each configured for movement relative to the remainder of the first connector terminal.

In exemplary embodiments, the conductive terminals each include a resiliently deformable element.

In exemplary embodiments, the positioning key is spaced a radial distance between the pair of conductive terminals that is equal to a radial distance at which the positioning groove is spaced between the pair of electrical contacts.

In exemplary embodiments, the pair of conductive terminals in each of the first and second connector terminals is outside of the hole in the center of the power connector assembly.

In an exemplary embodiment of the present invention, a power connector assembly for use with a decorative tree comprises a first connector terminal and a second connector terminal. The first connector terminal defines a hole extending therethrough for receiving a portion of a decorative tree, and the second connector terminal defines a hole extending therethrough for receiving a portion of a decorative tree. The first connector terminal comprises a raised step including an annular wall with a discontinuity that defines a positioning groove, and a pair of electrical contacts exposed on the annular wall. The second connector terminal comprises an annular recess configured to receive the raised step, an annular ring disposed within the annular recess and having a pair of conductive terminals extending therefrom, each configured for contact with a corresponding electrical contact of the pair of electrical contacts, and a positioning key extending from the annular ring and configured for insertion into the positioning groove.

In an exemplary embodiment, each of the conductive terminals is configured for movement relative to the remainder of the first connector terminal.

In an exemplary embodiment, the conductive terminals each include a resiliently deformable element.

In an exemplary embodiment, the positioning key is spaced a radial distance between the pair of electrical contacts that is equal to a radial distance at which the positioning groove is spaced between the pair of conductive terminals.

In an exemplary embodiment, the pair of conductive terminals in each of the first and second connector terminals is outside of the hole in the center of the power connector assembly.

BRIEF DESCRIPTION OF THE DRAWINGS

Exemplary embodiments of this invention will be described with reference to the accompanying figures, wherein.

DETAILED DESCRIPTION OF EMBODIMENTS

Figure 1:
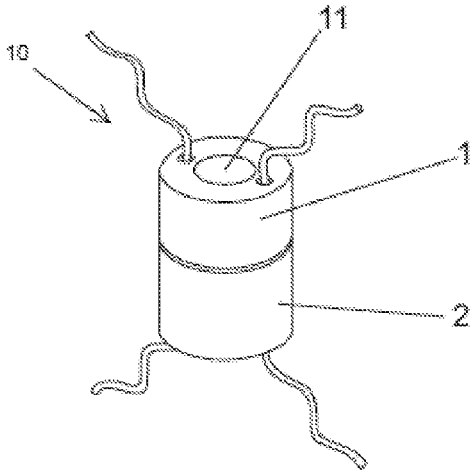
FIG. 1 is a perspective view of a connected power connector assembly according to an exemplary embodiment of the present invention.

Exemplary embodiments of the present invention are described herein with reference to the drawing figures. As described herein, a power connector assembly may be provided configured for safe and quick connection and may be used, for example, on a pre-lit decorative tree, such as a Christmas, Winter, or other holiday or seasonal decorative tree.

With specific reference to FIG. 1, a power connector assembly 10 includes a male mating connector terminal 1 and a female mating connector terminal 2. Male mating connector terminal 1 has an annular configuration that defines a central hole 11 extending therethrough. Similarly, female mating connector terminal 2 has an annular configuration that defines a central hole 21 (FIG. 2) extending therethrough. Upon coupling of the male mating connector terminal 1 and female mating connector terminal 2, holes 11 and 21 may be aligned, as shown, so that an interior channel is defined to receive another structure, such as that of a decorative tree, as described further herein.

Figure 2:
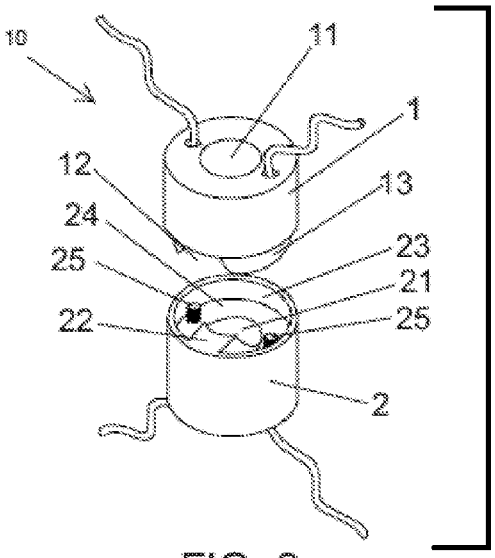
FIG. 2 is a top perspective view of the power connector assembly of FIG. 1 in a detached configuration.
Figure 3:
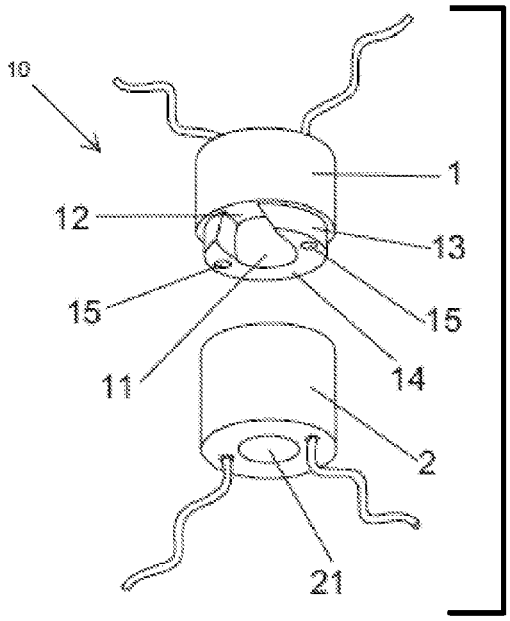
FIG. 3 is a bottom perspective view of the detached power connector assembly of FIG. 1.

Referring to FIG. 2 and FIG. 3, the male mating connector terminal 1 includes a raised step 14 formed of an annular wall 13 with a discontinuity that defines a positioning groove or keyway 12. A pair of conductive contacts 15 is disposed within the annular wall 13 and each of the conductive contacts is exposed on the raised step 14 for transmitting electrical power through the power connector assembly 10, as described further herein.

Still referring to FIG. 2 and FIG. 3, female mating connector terminal 2 defines an annular recess 23 for receiving the raised step 14 of the male mating connector terminal 1. An annular ring 24 extends along a bottom portion of the annular recess 23, and includes a pair of conductive terminals 25 extending therefrom for engagement with the corresponding pair of conductive contacts 15 on the male mating connector terminal 1 so that electrical power can be transferred therethrough. In this regard, the male mating connector terminal 1 and female mating connector terminal 2 may each have a body surrounding the respective conductive contacts 15 and conductive terminals 25 that is formed of an electrically insulative material, for example, a polymeric material such as plastic, so that a user can manually engage the male mating connector terminal 1 and female mating connector terminal 2 without the risk of receiving an electrical shock.

As shown, a positioning key 22 protrudes from the annular ring 24 in the annular recess 23, as shown, and is configured for insertion into the positioning groove or keyway 12 upon coupling of the male mating connector terminal 1 and the female mating connector terminal 2. In this regard, upon coupling of the male mating connector terminal 1 and the female mating connector terminal 2, a user can easily and quickly determine a proper rotational orientation of the male mating connector terminal 1 and female mating connector terminal 2, e.g., so that the pair of conductive contacts 15 are aligned with the respective pair of conductive terminals 25, by rotating male mating connector terminal 1 and female mating connector terminal 2 relative to one another until the positioning key 22 is aligned with and inserted into the positioning groove or keyway 12.

Conductive terminals 25 protrude upwardly from the annular groove 24 and are configured for moveable engagement with the pair of conductive contacts 15 so that, upon insertion of the raised step 14 into the annular recess 23, or vice-versa, the pair of conductive terminals 25 can be moved, for example, further downwardly into the annular recess 23 and/or interiorly into the body of female mating connector terminal 2. Accordingly, conductive terminals 25 may incorporate structure configured to allow or facilitate forced movement of conductive terminals 25, e.g., springs or other resiliently deformable elements.

In embodiments, it will be understood that the placement of conductive contacts 15 and conductive terminals 25 can be switched, e.g., the pair of conductive terminals 25 may be disposed on the male component connector terminal 1 and the pair of conductive contacts 15 may be disposed on the female component connector terminal 2.

Figure 4:
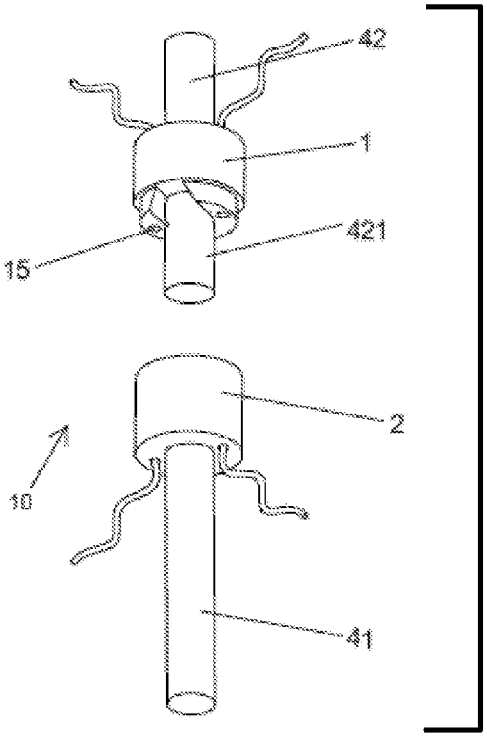
FIG. 4 is a bottom perspective view of the detached power connector assembly of FIG. 1 shown together with a portion of a decorative tree according to an exemplary embodiment of the present invention.
Figure 5:
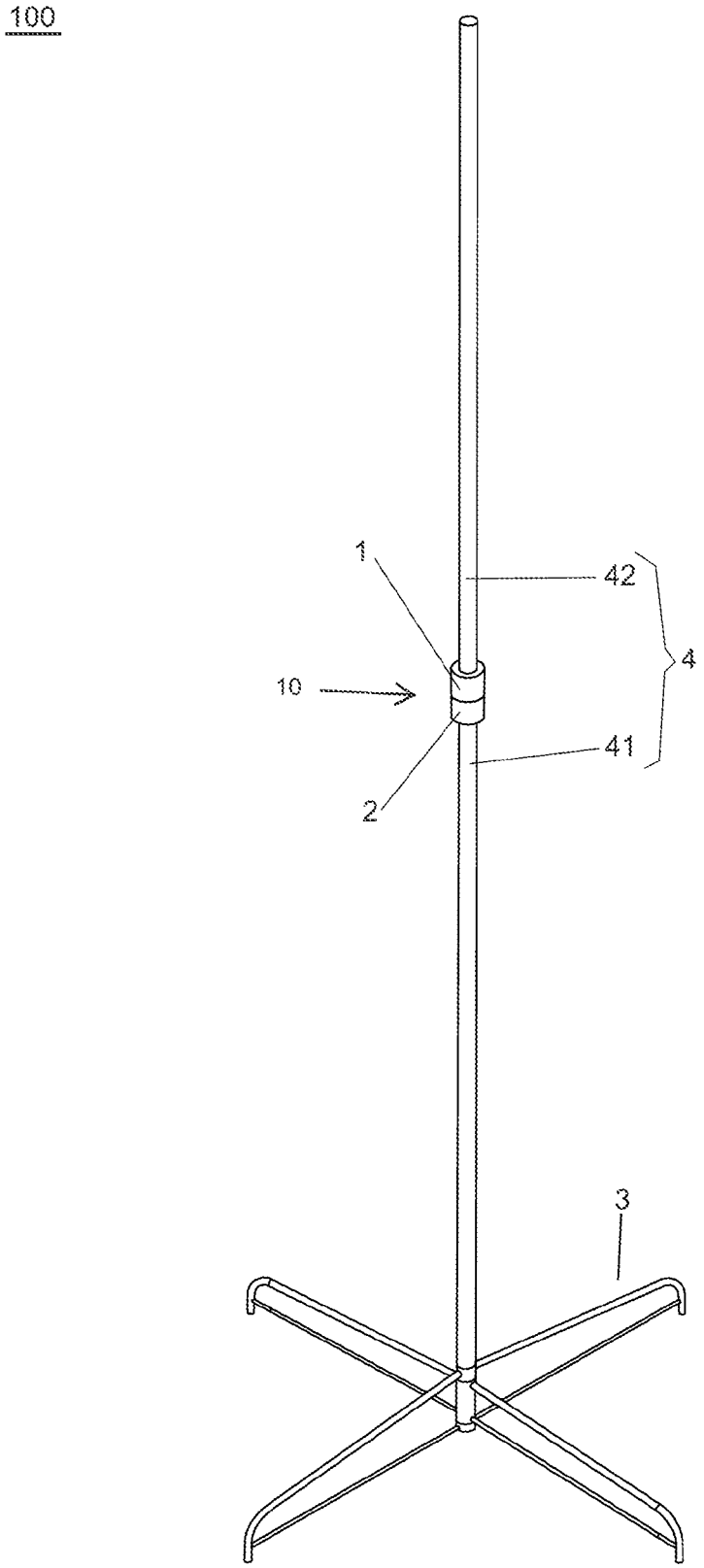
FIG. 5 is a perspective view of a decorative tree including the power connector assembly of FIG. 1 according to an exemplary embodiment of the present invention.

Referring additionally to FIGS. 4 and 5, the power connector assembly 10 can be used, for example with a decorative tree 100. Decorative tree 100, as shown, can include a base 3 coupled with a vertical column 4. In the exemplary embodiment shown, vertical column 4 includes a first hollow tube 41 and a second hollow tube 42. Either or both of first hollow tube 41 and second hollow tube 42 may extend through the holes 11 and 21 defined through the male mating connector terminal 1 and the female mating connector terminal 2 so that the power connector assembly 10 is circumferentially disposed about the vertical column 4. In the exemplary embodiment shown, a connecting tube 421 is provided to couple first hollow tube 41 and second hollow tube 42. Connecting tube 421 is optional and may be configured to interfit, e.g., telescopically fit, press fit, friction fit, or interference fit, with one or both of the first hollow tube 41 and second hollow tube 42. Connecting tube 421 may be disposed through the holes 11 and 21 through the male mating connector terminal 1 and the female mating connector terminal 2, respectively, or may be disposed along another portion of vertical column 4. Alternatively, first and second hollow tubes 41 and 42 may fit within each other telescopically or both hollow tubes 41, 42 may fit within connecting tube 421 or vice versa.

In embodiments, first and/or second hollow tubes 41 and 42 may include additional features, for example, collapsible branches or other structures, and/or additional features disposed independently of or on the branches, such as lights, tinsel, or garland, to name a few, and which are not shown for ease of illustration. It will be understood that in embodiments, vertical column 4 may include a different number of hollow tubes, for example, three or more hollow tubes to vary the height of the decorative tree 100. Adjacent pairs of tubes may be connected by power connector assemblies 10 so that the entire tree can be electrically connected.

In order to transfer electrical power along portions of the decorative tree 100, for example, to illuminate electrical lights disposed about the decorative tree 100, a power supply may be placed in electrical communication with the power connector assembly 10 (not shown). Specifically, upon coupling the male mating connector terminal 1 and the female mating connector terminal 2 in the manner described above, respective conductive contacts 15 and conductive terminals 25 are brought into contact so that an electrical circuit is formed. As described above, compression and rotation of the male mating connector terminal 1 and female mating connector terminal 2 relative to one another by a user during assembly will eventually result in the proper alignment of electrical contacts 15 and conductive terminals 25, respectively, upon alignment and insertion of the positioning key 22 into the positioning groove or keyway 12. Upon such coupling, one respective pair of the coupled electrical contacts 15 and conductive terminals 25 can be connected to a negative terminal of the power supply and the other respective pair of coupled electrical contacts 15 and conductive terminals 25 can be connected to a positive terminal of the power supply so that upon coupling of the power connector assembly 10 in the manner described above, portions of an electrical circuit located above the power connector assembly 10, e.g., one or more strands of electrically-powered lights, and portions of an electrical circuit located below the power connector assembly 10, e.g., one or more other strands of electrically-powered lights, can be interconnected and provided with a single path for electrical communication to a power source, as opposed to separately supplying power to the different portions of the electrical circuit. Further, the power connector assembly 10 allows for quick disconnection by a user, for example, in order to disassemble the decorative tree 100 for storage or to move it to a new location, or in an emergency situation in which disconnection of the flow of electrical power between different electrical components of the decorative tree 100 is necessitated.

While this invention has been described in conjunction with the embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A decorative tree, comprising:

a base;

a vertical column supported by the base and comprising a plurality of interconnected hollow tubes; and a power connector assembly circumferentially disposed outside the plurality of interconnected hollow tubes and comprising:

a first connector terminal on a first hollow tube comprising a raised step including an annular wall with a discontinuity that defines a positioning groove, a pair of electrical contacts exposed on the annular wall;

a second connector terminal on a second hollow tube comprising an annular recess configured to receive the raised step, an annular ring disposed within the annular recess and having a pair of conductive terminals extending therefrom, each configured for contact with a corresponding electrical contact of the pair of electrical contacts in the first connector terminal, and a positioning key extending from the annular ring in the second connector terminal and configured for insertion into the positioning groove in the first connector terminal.

2. The decorative tree of claim 1, wherein a body of the first connector terminal surrounding the pair of electrical contacts is formed of an electrically insulative material.

3. The decorative tree of claim 1, wherein a body of the second connector terminal surrounding the pair of conductive terminals is formed of an electrically insulative material.

4. The decorative tree of claim 1, wherein the conductive terminals in the second connector terminal are each configured for compressive movement relative to the remainder of the second connector terminal.

5. The decorative tree of claim 4, wherein the pair of conductive terminals each include a resiliently deformable element.

6. The decorative tree of claim 1, wherein the plurality of hollow tubes of the vertical column includes two hollow tubes.

7. The decorative tree of claim 6, further comprising a connecting tube configured for interconnecting the two hollow tubes.

8. The decorative tree of claim 1, wherein the first connector terminal defines a hole therethrough for receiving a portion of the vertical column.

9. The decorative tree of claim 1, wherein the second connector terminal defines a hole therethrough for receiving a portion of the vertical column.

10. The decorative tree of claim 1, wherein the positioning key is spaced a radial distance between the pair of conductive terminals that is equal to a radial distance at which the positioning groove is spaced between the pair of electrical contacts.

11. A power connector assembly for use with a decorative tree, comprising:

a first connector terminal defining a hole extending therethrough, the first connector terminal circumferentially disposed outside one or more hollow tubes of the decorative tree, the first connector terminal defining:

a raised step including an annular wall with a discontinuity that defines a positioning groove; and a pair of conductive terminals extending from the annular wall; and a second connector terminal defining a hole extending therethrough, the first connector terminal circumferentially disposed outside one or more hollow tubes of the decorative tree, the second connector terminal comprising:

an annular recess configured to receive the raised step;

an annular ring disposed within the annular recess and having a pair of electrical contacts disposed thereon, each configured for contact with a corresponding conductive terminal of the pair of conductive terminals; and a positioning key extending from the annular ring and configured for insertion into the positioning groove.

12. The decorative tree of claim 11, wherein a body of the second connector terminal surrounding the pair of electrical contacts is formed of an electrically insulative material.

13. The decorative tree of claim 11, wherein a body of the first connector terminal surrounding the pair of conductive terminals is formed of an electrically insulative material.

14. The decorative tree of claim 11, wherein the conductive terminals are each configured for movement relative to the remainder of the first connector terminal.

15. The decorative tree of claim 14, wherein the conductive terminals each include a resiliently deformable element.

16. The decorative tree of claim 11, wherein the positioning key is spaced a radial distance between the pair of conductive terminals that is equal to a radial distance at which the positioning groove is spaced between the pair of electrical contacts.

17. A power connector assembly for use with a decorative tree, comprising:

a first connector terminal defining a hole extending therethrough, the first connector terminal circumferentially disposed outside one or more hollow tubes of the decorative tree, the first connector terminal defining:

a raised step including an annular wall with a discontinuity that defines a positioning groove;

a pair of electrical contacts exposed on the annular wall;

a second connector terminal defining a hole extending therethrough, the second connector terminal circumferentially disposed outside one or more hollow tubes of the decorative tree, the second connector terminal comprising:

an annular recess configured to receive the raised step;

an annular ring disposed within the annular recess and having a pair of conductive terminals extending therefrom, each configured for contact with a corresponding electrical contact of the pair of electrical contacts; and a positioning key extending from the annular ring and configured for insertion into the positioning groove.

18. The decorative tree of claim 17, wherein the conductive terminals are each configured for movement relative to the remainder of the first connector terminal.

19. The decorative tree of claim 18, wherein the conductive terminals each include a resiliently deformable element.

20. The decorative tree of claim 17, wherein the positioning key is spaced a radial distance between the pair of electrical contacts that is equal to a radial distance at which the positioning groove is spaced between the pair of conductive terminals.

21. A decorative tree, comprising:

a base;

a vertical column supported by the base and comprising a plurality of interconnected hollow tubes; and a power connector assembly circumferentially disposed outside the plurality of interconnected hollow tubes and comprising:

a first connector terminal on a first hollow tube comprising a raised step including an annular wall with a discontinuity that defines a positioning groove, a pair of electrical contacts disposed within the annular wall;

a second connector terminal on a second hollow tube comprising an annular recess configured to receive the raised step, an annular ring disposed within the annular recess and having a pair of conductive terminals extending therefrom, each configured for contact with a corresponding electrical contact of the pair of electrical contacts in the first connector terminal, and a positioning key extending from the annular ring in the second connector terminal and configured for insertion into the positioning groove in the first connector terminal.

22. The decorative tree of claim 1, wherein a body of the first connector terminal surrounding the pair of electrical contacts is formed of an electrically insulative material.

23. The decorative tree of claim 21, wherein a body of the second connector terminal surrounding the pair of electrical contacts is formed of an electrically insulative material.

24. The decorative tree of claim 21, wherein the plurality of hollow tubes of the vertical column includes two hollow tubes.

25. The decorative tree of claim 24, further comprising a connecting tube configured for interconnecting the two hollow tubes.

26. The decorative tree of claim 21, wherein the first connector terminal defines a hole therethrough for receiving a portion of the vertical column.

27. The decorative tree of claim 21, wherein the second connector terminal defines a hole therethrough for receiving a portion of the vertical column.

28. The decorative tree of claim 21, wherein the positioning key is spaced a radial distance between the pair of conductive terminals that is equal to a radial distance at which the positioning groove is spaced between the pair of electrical contacts.

29. A power connector assembly for use with a decorative tree, comprising:

a first connector terminal defining a hole extending therethrough, the first connector terminal circumferentially disposed outside one or more hollow tubes of the decorative tree, the first connector terminal defining:

a raised step including an annular wall with a discontinuity that defines a positioning groove; and a pair of conductive terminals extending from the annular wall; and a second connector terminal defining a hole extending therethrough, the first connector terminal circumferentially disposed outside one or more hollow tubes of the decorative tree, the second connector terminal comprising:

an annular recess configured to receive the raised step;

an annular ring disposed within the annular recess and having a pair of electrical contacts disposed within the annular ring, each configured for contact with a corresponding conductive terminal of the pair of conductive terminals; and a positioning key extending from the annular ring and configured for insertion into the positioning groove.

30. The power connector assembly of claim 29, wherein a body of the first connector terminal surrounding the pair of conductive terminals is formed of an electrically insulative material.

31. The power connector assembly of claim 29, wherein a body of the second connector terminal surrounding the pair of electrical contacts is formed of an electrically insulative material.

32. The power connector assembly of claim 29, wherein the positioning key is spaced a radial distance between the pair of electrical contacts that is equal to a radial distance at which the positioning groove is spaced between the pair of conductive terminals.

33. A power connector assembly for use with a decorative tree, comprising:

a first connector terminal defining a hole extending therethrough, the first connector terminal circumferentially disposed outside one or more hollow tubes of the decorative tree, the first connector terminal defining:

a raised step including an annular wall with a discontinuity that defines a positioning groove;

a pair of electrical contacts disposed within the annular wall;

a second connector terminal defining a hole extending therethrough, the second connector terminal circumferentially disposed outside one or more hollow tubes of the decorative tree, the second connector terminal comprising:

an annular recess configured to receive the raised step;

an annular ring disposed within the annular recess and having a pair of conductive terminals extending therefrom, each configured for contact with a corresponding electrical contact of the pair of electrical contacts; and a positioning key extending from the annular ring and configured for insertion into the positioning groove.

34. The power connector assembly of claim 33, wherein a body of the first connector terminal surrounding the pair of conductive terminals is formed of an electrically insulative material.

35. The power connector assembly of claim 33, wherein a body of the second connector terminal surrounding the pair of electrical contacts is formed of an electrically insulative material.

36. The power connector assembly of claim 33, wherein the positioning key is spaced a radial distance between the pair of conductive terminals that is equal to a radial distance at which the positioning groove is spaced between the pair of electrical contacts.

* * * * *